US006137090A

United States Patent [19]

Dittmar et al.

[11] Patent Number: 6,137,090

[45] Date of Patent: Oct. 24, 2000

[54] HEAT CONDUCTOR FOR A COOKING PLATE

[75] Inventors: Gunter Dittmar, Aalen; Roman-Hartmut Wauer, Kisslegg, both of Germany

[73] Assignee: Diehl AKO Stiftung & Co. KG, Wangen, Germany

[21] Appl. No.: 09/269,111

[22] PCT Filed: Sep. 16, 1997

[86] PCT No.: PCT/EP97/05055

§ 371 Date: Mar. 19, 1999

§ 102(e) Date: Mar. 19, 1999

[87] PCT Pub. No.: WO98/12898

PCT Pub. Date: Mar. 26, 1999

[30] Foreign Application Priority Data

Sep. 21, 1996 [DE] Germany ..... 196 38 832

[51] Int. Cl.[7] ..... H05B 3/68; H05B 3/08

[52] U.S. Cl. ..... 219/465.1; 219/541

[58] Field of Search ..... 219/465.1, 466.1, 219/541, 542, 543; 338/280, 281, 282, 296, 297, 307, 308, 309

[56] References Cited

U.S. PATENT DOCUMENTS

| | | | |
|---|---|---|---|
| 2,399,753 | 5/1946 | McLarn | 219/56.1 |
| 3,495,328 | 2/1970 | Ziver . | |
| 4,286,377 | 9/1981 | Hurko et al. . | |
| 4,500,865 | 2/1985 | Tanaka et al. | 339/307 |
| 4,859,835 | 8/1989 | Balderson | 219/543 |

*Primary Examiner*—Sang Paik

*Attorney, Agent, or Firm*—Scully, Scott, Murphy & Presser

[57] ABSTRACT

A heating conductor which can be fitted in a geometrical pattern into a radiant heating body is to be easy to fit and is to have good radiation properties. The heating conductor is separated in the form or partial form of the geometrical pattern out of a metal foil and forms heating limbs (1). In the geometrical pattern there are stabilisation limbs (5) whose width is less than the width of the heating limbs (1) in such a way that they can burn through upon the application of an electrical voltage which is harmless to the heating limbs (1).

5 Claims, 5 Drawing Sheets

HEAT CONDUCTOR FOR A COOKING PLATE

BACKGROUND OF THE INVENTION

1. Field of the Invention

The invention concerns a heating conductor which can be fitted in a geometrical pattern into a radiant heating body of a cooking hob.

2. Description of the Prior Art

A heating conductor comprising a flat strip is described in DE 42 29 375 A1 and EP 0 585 832 A1. The desired spiral-shaped geometrical pattern is formed by the flat strip being laid in suitable turns on an insulating bottom of the radiant heating body. In that arrangement the large surfaces of adjacent flat strip portions face towards each other. Only the narrow edges of the flat strip face towards the cooking hob or surface.

In accordance with DE 38 00 676 A1 a flat strip heating conductor of that kind is laid in a star-shaped geometrical pattern.

Flat strip heating conductors of that kind are complicated and expensive to lay and to fix to the insulating bottom. Their narrow edges which are towards the cooking surface or hob cover only a small part of the cooking hob.

EP 0 175 662 B1 describes a heating conductor whose geometrical pattern is formed by stamping out of a foil laminate including a metal foil. That heating conductor is only suitable for temperatures of up to a maximum of 400° C. and thus cannot be used for a radiant heating body. Flexibility of the heating conductor is desirable in this case because it is to be fitted into vehicle seats. Disposed between the current connections is an auxiliary web which is to be cut out after the electrical connections have been made.

SUMMARY OF THE INVENTION

The object of the present invention is to propose a heating conductor of the kind set forth in the opening part of this specification, which can be easily mounted in radiant heating bodies and which has good radiation properties.

In accordance with the invention the foregoing object is attained by a heating conductor which can be fitted in a geometrical pattern into a radiant heating body of a cooking hob.

Because of the thinness of the metal foil, for example 0.05 mm to 0.1 mm, and the size of the diameter of the geometrical pattern, for example 10 cm to 30 cm, a heating conductor of that kind is a delicate structure which has little stability in respect of shape and which in itself bends easily and in which the heating limbs bend easily. That increases difficulties in regard to handleability upon transportation and assembly.

In order to stabilise the heating conductor, stabilisation limbs are left in the operation of severing the heating conductor out of the metal foil, the stabilisation limbs resulting in a certain degree of stiffening of the structure of the heating conductor so that transportation and assembly thereof is less susceptible to trouble. However the stabilisation limbs necessarily form in the heating conductor undesired electrical short-circuits between the heating limbs. They must be removed prior to operation. That is effected by applying an electrical voltage which results, in the stabilisation limbs, in a current which heats them up in such a way that they burn out. When that happens the heating limbs are not damaged as the width thereof is substantially greater than that of the stabilisation limbs. The thickness of the stabilisation limbs and the heating limbs is the same because they come from the same metal foil.

Preferably each two adjacent heating limbs are connected to holding tongues or connecting limbs and the stabilisation limbs are provided between adjacent holding tongues or connecting limbs. In order to provide a smooth external contour for the geometrical pattern, the stabilisation limbs extend on the outside at the geometrical pattern.

BRIEF DESCRIPTION OF THE DRAWINGS

Further advantageous configurations of the invention are set forth in the following description of embodiments given by way of example. In the drawing.

DETAILED DESCRIPTION OF THE PREFERRED EMBODIMENTS

The heating conductor is separated in a desired geometrical pattern out of a thin metal foil which is the same thickness throughout, for example by a cutting operation, a stamping operation or an etching operation. The thickness of the metal foil is for example about 0.05 mm to 0.1 mm. The heating conductor forms heating limbs 1, the width of which, in conjunction with the specific electrical resistance of the metal foil, is so selected that the heating limbs are incandescent in operation. In that situation they assume temperatures of over 600° C. to 1100° C. The width of the heating limbs is substantially greater than their thickness, that is to say the thickness of the metal foil. The width is about 2 mm to 4 mm. The width of the heating limbs is in the plane of the geometrical pattern.

Figure 1:
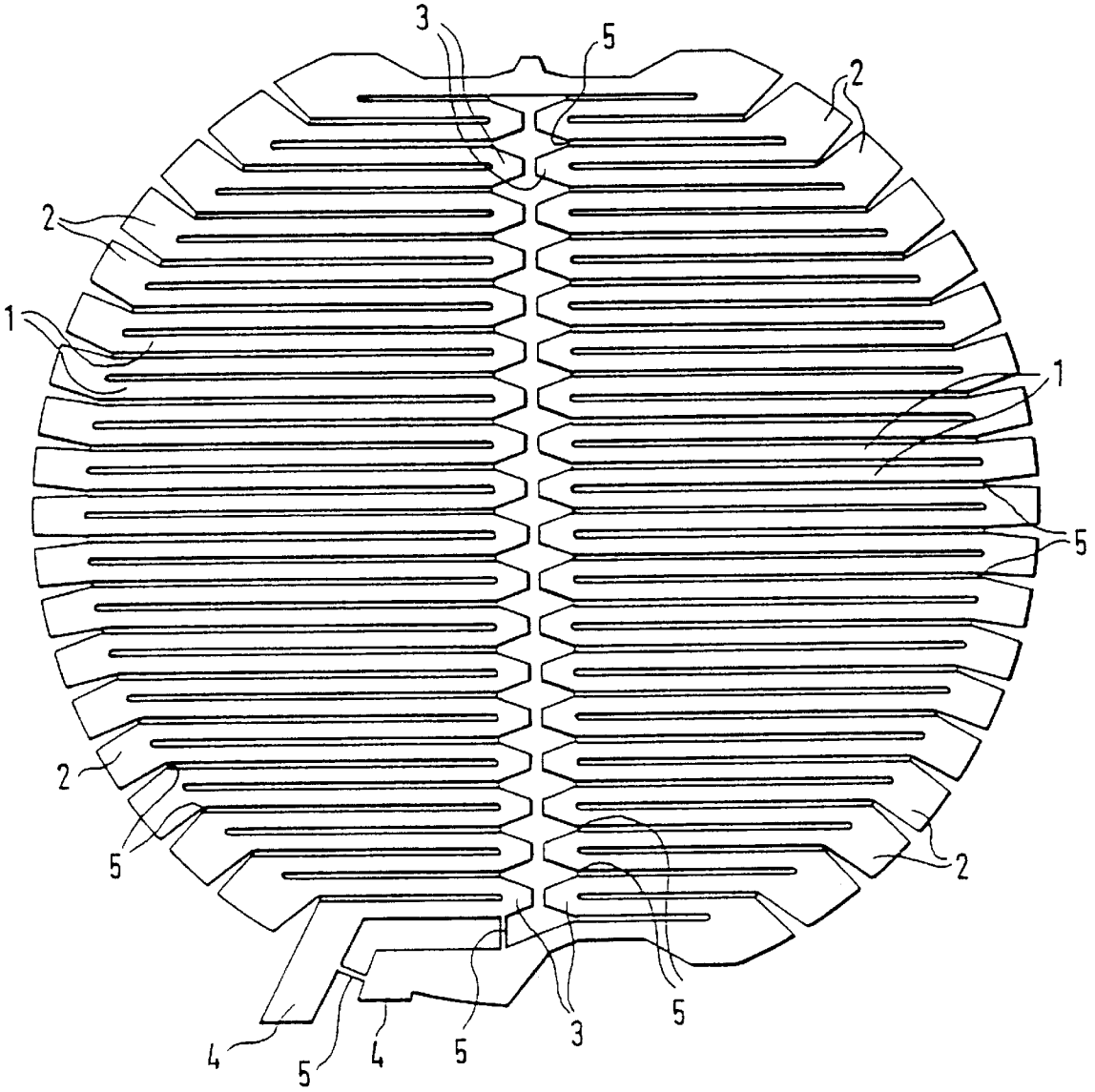
FIG. 1 shows a heating conductor with parallel heating limbs in its two halves.
Figure 2:
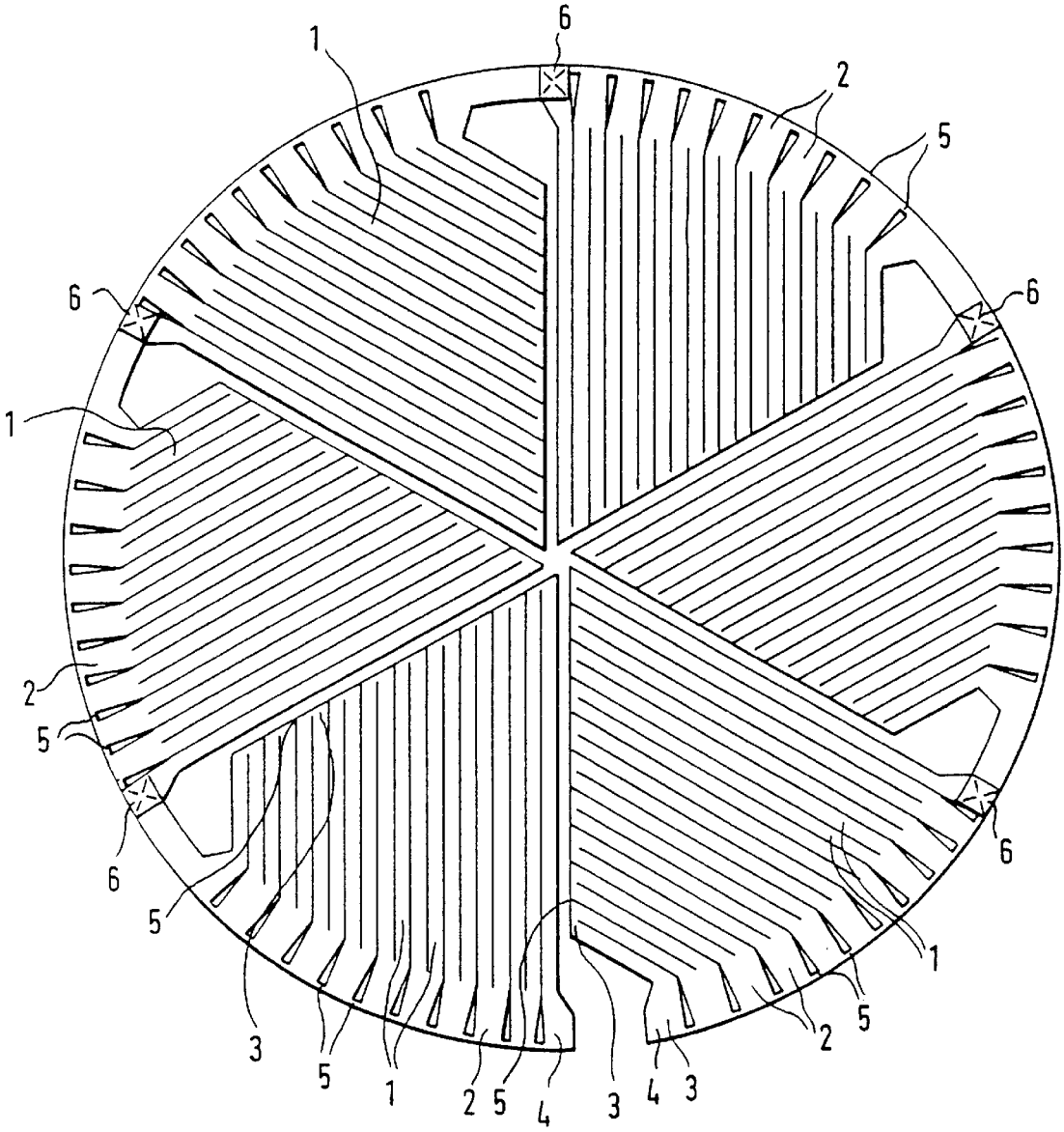
FIG. 2 shows a heating conductor which is composed of six segments.
Figure 3:
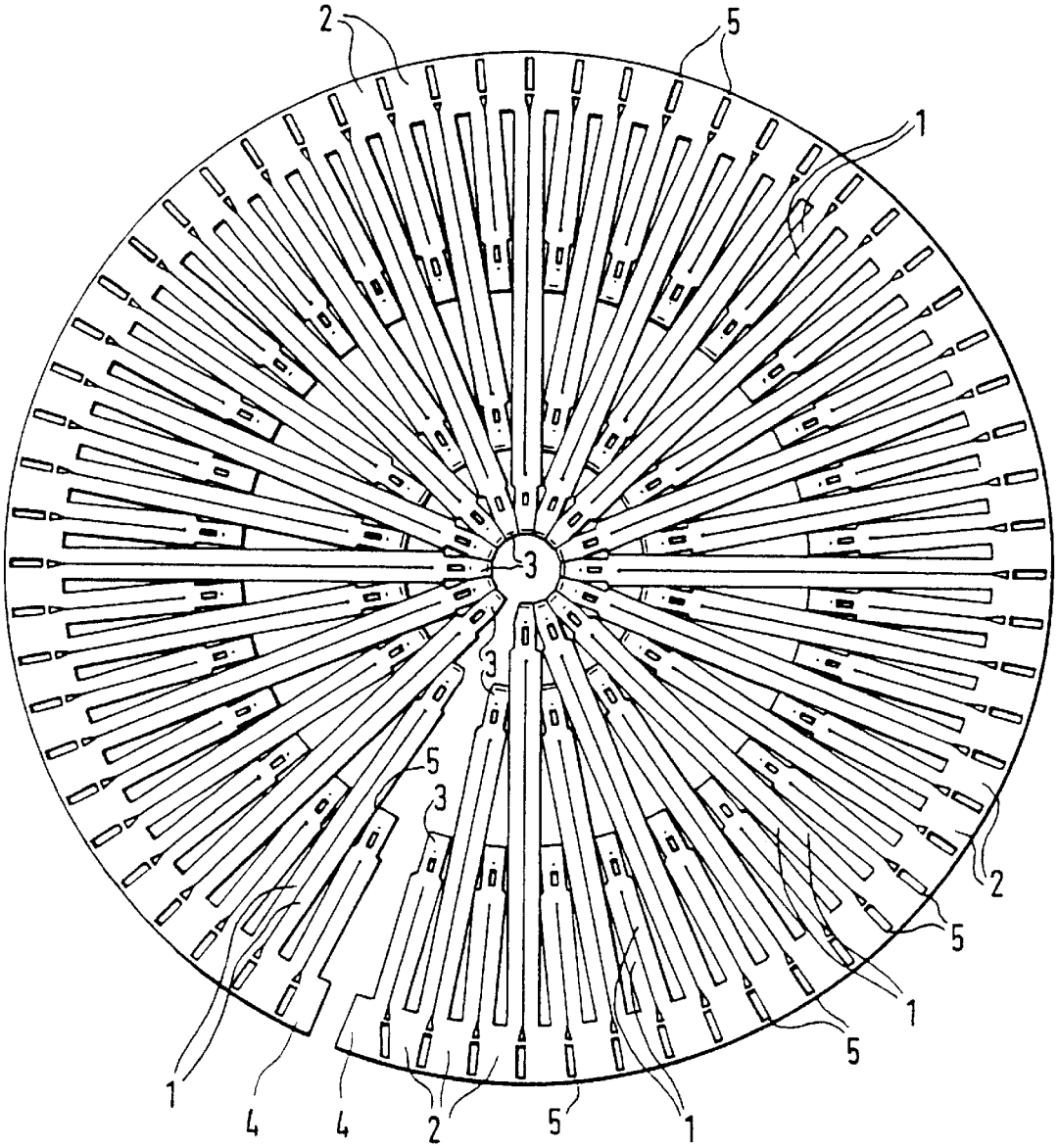
FIG. 3 shows a heating conductor involving a star-shaped pattern.

The heating conductors shown in FIGS. 1 to 3 have outer holding plate portions or tongues 2 which lie on a circular periphery which is usual in connection with cooking hobs. The outer holding tongues 2 connect each two mutually parallel heating limbs 1. Inner holding tongues 3 connect the parallel heating limbs 1 at their ends remote from the holding tongues 2 so that in the final result the heating limbs 1 are electrically connected in series. Current connections 4 are also formed on the heating conductor. The outer holding tongues 2, the inner holding tongues 3 and the current connections 4 are wider than the heating limbs 1 in such a way that in operation they do not go to incandescent temperature.

In the heating conductor shown in FIG. 1 the heating limbs 1 extend in respectively parallel relationship in a right-hand and a left-hand semicircle. In that arrangement the inner holding tongues 3 lie in two rows of a diagonal zone of the circular shape. Stabilisation limbs 5 are provided between each two adjacent holding tongues 2 and inner holding tongues 3 and the current connections 4. Not all stabilisation limbs are identified by reference numeral 5 in the Figures, for the sake of simplification thereof. The stabilisation limbs 5 are allowed to remain in the operation of separating the heating conductor out of the metal foil. The width of the stabilisation limbs 5, being the width through which current flows, is substantially less than the width of the heating limbs 1.

The stabilisation limbs 5 provide for a stiffening action in respect of the heating conductor. This arrangement also guarantees that the heating limbs 1 cannot buckle upon transportation and assembly.

In the embodiment shown in FIG. 2 the heating conductor is composed of six substantially identical segments which are electrically and mechanically connected together at connecting locations 6. Each segment has outer holding tongues 2 and inner holding tongues 3. Between adjacent holding tongues there are respective stabilisation limbs 5 which in this case also are not all identified. The stabilisation limbs 5 of the outer holding tongues 2 are disposed on the outer periphery of the circular shape. That gives a smooth external contour which prevents a hooking action.

The heating conductor shown in FIG. 3 has a star-shaped pattern. A respective pair of parallel heating limbs 1 form an arm of the star pattern. All outer holding tongues 2 which connect a respective pair of heating limbs are disposed on the circular periphery. The star arms are alternately radially different in length, wherein the inner holding tongues 3 which each connect a respective pair of heating limbs lie on circles of different diameters. In this case stabilisation limbs 5 are provided between the outer holding tongues 2. In addition stabilisation limbs 5 are provided between the inner holding tongues 3 and adjacent heating limbs 1.

Figure 4:
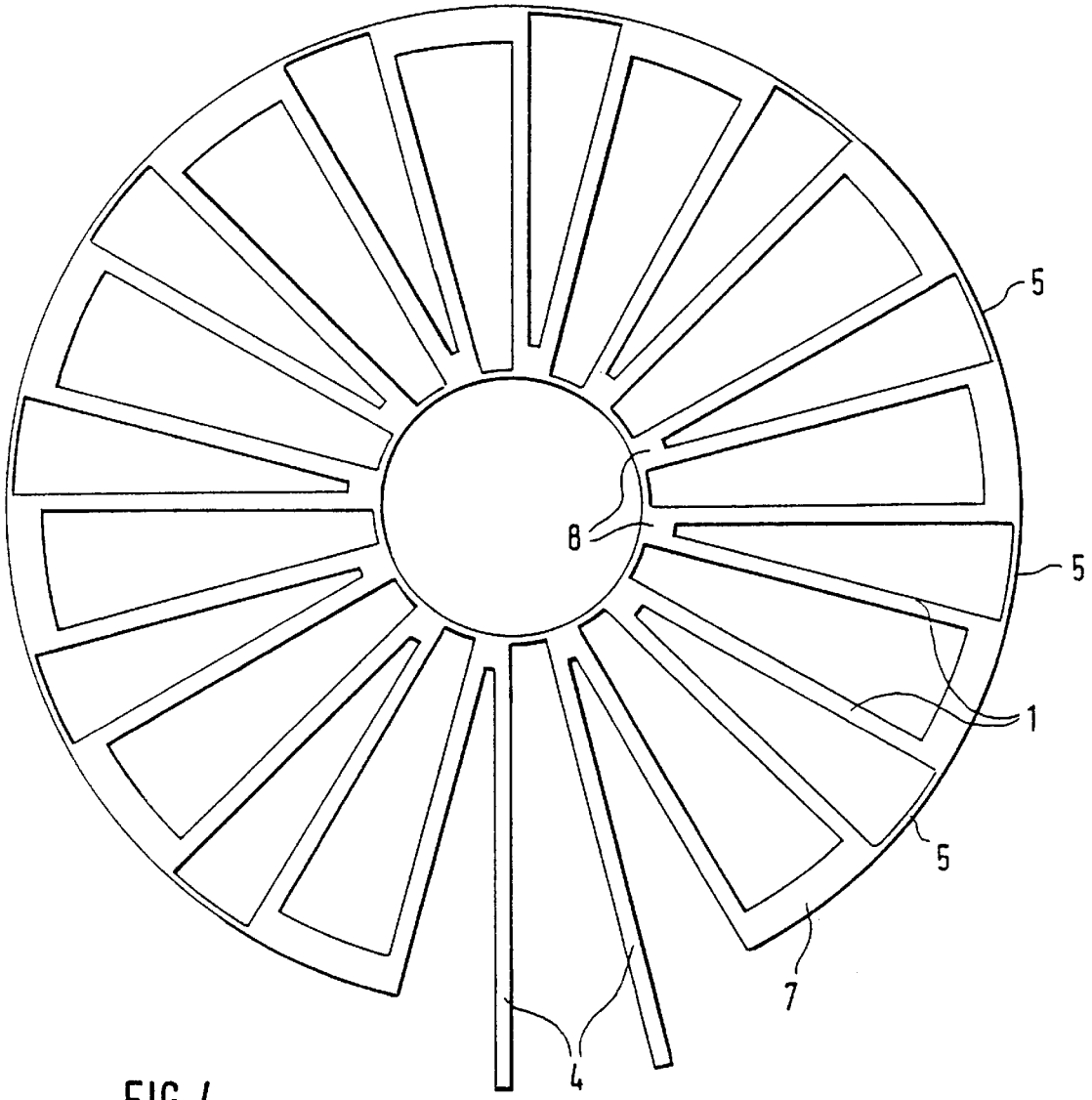
FIG. 4 shows a heating conductor with a star-shaped pattern which is simplified in comparison with FIG. 3.

In the heating conductor shown in FIG. 4 radial heating limbs 1 are connected on the outside to connecting limbs 7 and on the inside to connecting limbs 8. The connecting limbs 7, 8 can perform the functions of the holding tongues 2, 3. Specifically the outer connecting limbs 7 may also be of such a nature that they are incandescent in operation. tabilisation limbs 5 are provided between the respective outer onnecting limbs 7 and the inner connecting limbs 8.

Figure 5:
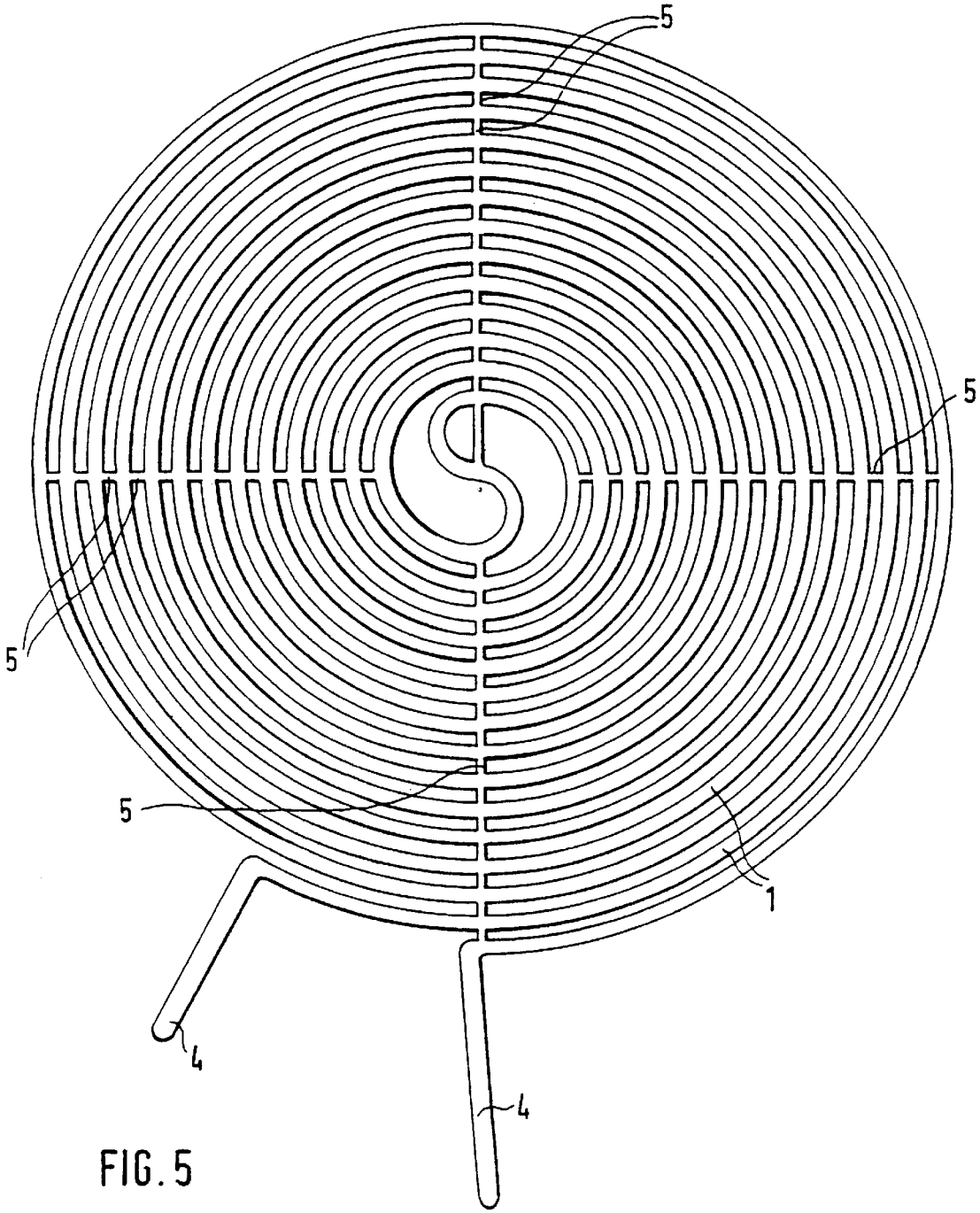
FIG. 5 shows a heating conductor with a spiral-shaped pattern.

FIG. 5 shows a heating conductor involving a spiral pattern. For stabilisation of the spiral shape during transportation and assembly, stabilisation limbs 5 are provided between adjacent turns of the heating limb 1. The stabilisation limbs 5 extend on four radial lines as shown in FIG. 5.

Numerous further arrangements of the stabilisation limbs 5 are included within the scope of the invention. In dependence on the respective geometrical pattern of the heating conductor, the stabilisatlon limbs 5 are always so arranged that they afford the desired stiffening effect.

The heating conductor which is separated out of the metal foil and which has the stabilisation limbs 5 is laid on a conventional insulating bottom disposed in a sheet metal cup member. The holding tongues 2, 3 are then fixed by means of holding members. Thereafter a uniform electrical voltage or an electrical voltage in pulse form is applied to the current connections 4 or to other suitable locations of the heating conductor. That voltage results in a flow of current in the stabilisation limbs 5. When that happens the stabilisation limbs 5 are heated up to such a high degree that they burn out and thus no longer represent electrical short-circuits between the heating limbs 1. After the stabilisation limbs 5 have burnt out or fused the radiant heating body is ready for operation and can be put into operation under a glass ceramic plate.

An additional stiffening effect for the heating conductor can be achieved by the heating limbs 1 being of a U-shape or V-shape profile in cross-section. The profiling effect is afforded after the operation of separating the heating conductor out of the metal foil and prior to assembly thereof in the radiant heating body.

What is claimed is:

1. A heating conductor which is installable in a geometrical pattern into a radiant heating body of a cooking hob, said heating conductor being separated in the form or at least partial form of the geometrical pattern out of a metal foil so as to constitute heating limbs (1); stabilization limbs (5) being formed in the plane of the geometrical pattern, said stabilization limbs (5) each having a width which is less than the width of the heating limbs (1) so that the stabilizing limbs (5) are burnt-through upon the application of an electrical voltage which is harmless to the heating limbs (1), said metal foil having a thickness of about between 0.05 to 0.1 mm at a diameter of about 100 to 300 mm of an essentially circular geometrical pattern, each two adjacent said heating limbs (1) being connected to holding tongues (2, 3) or connecting limbs (7, 8), said stabilization limbs (5) being arranged between, respectively, adjacent said holding tongues (2, 3) or connecting limbs (7, 8) where in, said heating conductor possesses current connections (4) which are wider than the heating limbs (1), and at least one said stabilization limb (5) is located between the current connections (4).

2. A heating conductor according to claim 1, wherein said stabilization limbs (5) are formed between inner and outer located of said holding tongues (2, 3) or connecting limbs (7, 8).

3. A heating conductor according to claim 1, wherein said stabilization limbs (5) extend at the outside on the geometrical pattern so as to form a smooth external contour of the heating conductor.

4. A heating conductor according to claim 1, wherein said heating conductor has a spirally-shaped geometrical pattern and the stabilization limbs (5) are located intermediate adjacent turns of the spirally-shaped geometrical pattern.

5. A heating conductor according to claim 1, wherein said heating limbs (1) are profiled in cross-section.

* * * * *